US005599458A

United States Patent [19]

Taboga

[11] Patent Number: 5,599,458

[45] Date of Patent: Feb. 4, 1997

[54] METHOD TO PREVENT THE EXHAUSTION OF ACID COPPER PLATING BATHS AND TO RECOVER METALLIC COPPER FROM SOLUTIONS AND SLUDGES CONTAINING COPPER IN AN IONIC FORM

[75] Inventor: Leandro Taboga, Colloredo di Monte Albano, Italy

[73] Assignee: Laboratori Taboga di Taboga Leandro, Colloredo di Monte Albano, Italy

[21] Appl. No.: 279,098

[22] Filed: Jul. 22, 1994

[30] Foreign Application Priority Data

Jul. 29, 1993 [IT] Italy ..... UD93A0148

[51] Int. Cl.[6] ..... C02F 1/62

[52] U.S. Cl. ..... 210/710; 210/712; 210/912; 204/DIG. 13; 423/146; 423/150.3

[58] Field of Search ..... 210/724, 912, 210/710, 712; 204/DIG. 13; 423/140, 146, 150.3

[56] References Cited

U.S. PATENT DOCUMENTS

| | | | |
|---|---|---|---|
| 2,754,174 | 7/1956 | Roberts | 204/DIG. 13 |
| 4,176,160 | 11/1979 | Pavonet | 423/104 |
| 4,324,629 | 4/1982 | Oka et al. | 204/130 |
| 4,549,946 | 10/1985 | Horn | 204/130 |
| 4,559,216 | 12/1985 | Nagai et al. | 210/688 |
| 4,600,493 | 7/1986 | Korngold | 204/301 |
| 5,266,212 | 11/1993 | Szotek | 210/729 |

FOREIGN PATENT DOCUMENTS

| | | | |
|---|---|---|---|
| 623658 | 5/1976 | Germany . | |
| 157184 | 1/1981 | Germany . | |
| 753927 | 8/1980 | U.S.S.R. | 204/DIG. 13 |
| 2250507 | 12/1990 | United Kingdom . | |

*Primary Examiner*—Neil McCarthy
*Attorney, Agent, or Firm*—Antonelli, Terry, Stout & Kraus

[57] ABSTRACT

Method to prevent the exhaustion of acid copper plating baths (12) and to treat sewage or sludges (20) containing copper in an ionic form so as to recover metallic copper (39), the method including the addition (11) of a compound which keeps the concentration of iron below a critical value (for instance, 60 grs/lt. ), the compound causing precipitation of iron in the form of ferrous sulphate and thus preventing the co-deposition of crystals of ferrous sulphate and copper sulphate with a possible incorporation of organic impurities such as stearates (35) present in the acid copper plating baths (12).

24 Claims, 2 Drawing Sheets

METHOD TO PREVENT THE EXHAUSTION OF ACID COPPER PLATING BATHS AND TO RECOVER METALLIC COPPER FROM SOLUTIONS AND SLUDGES CONTAINING COPPER IN AN IONIC FORM

BACKGROUND OF THE INVENTION

This invention concerns a method to prevent the exhaustion of acid copper plating baths and to recover metallic copper from solutions and sludges containing copper in an ionic form.

The method according to the invention is applied to the treatment of acid copper plating baths employed in plants which plate with copper, for instance, wedding rods or other iron or steel materials that have to be plated with copper, and is also applied to the treatment of fluids containing copper in an ionic form, such as the sewage from plants carrying out electrolytic or chemical engraving of copper, plants which wash copper plated objects, etc.

The method according to the invention is applied to individual copper plating baths and to centralised copper plating baths in which the same acid copper plating solution held in a reservoir is circulated through a plurality of copper plating tanks.

One of the methods of the state of the art for the copper plating of metallic objects made of steel, for instance, consists in the immersion of those objects, for instance in the form of rods, in a tank containing an acid copper plating bath consisting of an aqueous solution of sulphuric acid ($H_2SO_4$) and copper sulphate ($CuSO_4$).

As the object passes through the acid bath, copper ions are reduced and are deposited on the object and cover it, while iron ions pass into solution and form ferrous sulphate.

It has been found that, when the quantity of iron in the acid copper plating bath is greater than 60 grs/lt., copper plating defects appear which make the end product unsatisfactory, and therefore it is necessary to replace the spent acid copper plating bath with a new bath.

It has been found in particular that the copper plating defects consist in the formation of united crystals of ferrous sulphate and copper sulphate to form very hard crystals on the surface of the object thus plated with copper.

Where welding rods are being copper plated, the crystals incorporate also the stearates present as impurities in the bath.

Where rods are concerned, the surface crystals create sliding problems and tend to detach fragments of copper from the surface of the metallic rod.

The exhaustion of the acid copper plating bath entails very serious consequences for the plant inasmuch as these spent acid copper plating baths form toxic and damaging wastes and, as such, have to be disposed of or treated on the spot.

The costs of disposal of these acid baths are very high and therefore make burdensome the method of copper plating such objects.

One method employed to recover at least a part of the copper still contained in the spent acid baths consists of precipitation and of immersing in the spent acid bath iron supports on which is deposited the copper, which is then recovered by shaking and scraping the supports and by decantation, but this system often leads to the recovery of copper containing many impurities and therefore of low quality and not usable as such.

This method does not overcome the problem of treatment of spent acid baths since these spent acid baths, even after partial recovery of the copper by the above method, have to be neutralised with lime. This neutralisation produces a great mass of sludge containing soluble copper and therefore requiring treatment as a toxic and damaging waste.

Another method employed in the treatment of spent acid copper plating baths provides for neutralisation of the spent acid copper plating bath with lime followed by a step of rendering the bath inert, generally performed with cement, thereby producing still more sludge, which has to be disposed of at a dump at a high cost.

According to Italian regulations governing the disposal of sludges (Decree No. 915/82 of the President of the Republic and subsequent changes and supplements) this method enables these toxic and damaging sludges to be derated to the status of special non-toxic and non-damaging sludges, which can be disposed of in dumps of type IIB, but this treatment requires great investments, which increase considerably the cost of disposal of these wastes as regards both the treatment in itself and the transport of the sludges from their production plant to the treatment plant and thence to the dump.

Moreover, this treatment in no way makes possible the recovery of the raw material, mainly copper, in such sludges, as instead was foreseen in the above regulations and was hoped for by the plant operators themselves with a view to reducing the costs of the copper plating treatment.

Furthermore, when the concentration of iron in the acid copper plating bath is higher than 60 grs/lt., incrustations form on the bottom and sidewalls of the tanks containing the acid baths.

These incrustations caused by co-deposition of ferrous sulphate and copper sulphate have to be removed by heavy manual labour.

SUMMARY OF THE INVENTION

The present applicants have investigated, tested and brought about this invention to overcome the shortcomings of the state of the art and to achieve further advantages.

The purpose of this invention is to provide a method which prevents exhaustion of acid copper plating baths and enables the same acid copper plating bath to be always used, whereby it is only necessary to re-establish periodically the contents of copper, sulphuric acid and water and to remove the sediment consisting of salts of iron and/or sodium and/or potassium and/or calcium.

The method according to the invention prevents the content of ionic iron in the acid bath exceeding a pre-set value lower than the critical value (60 grs/lt., for instance) and ensures at all times a copper plating of excellent quality and substantially free of defects.

The concentration of iron can even be kept at values of about 10–20 grs/lt. by greater use of reagents.

The method according to the invention also enables the solid crystals to be treated which are deposited on the bottom of the copper plating tank, thus obtaining a solution of sulphuric acid and copper sulphate which can be re-used by being re-cycled directly into the acid copper plating baths.

Moreover, the method according to the invention increases the speed of depositing of the copper on the objects to be copper plated, thus reducing the immersion times and increasing the output of the copper plating plants.

The method according to the invention provides for the continuous or discontinuous addition of a reagent, in a solid form or in a solution, which prevents formation of the crystals of copper sulphate and ferrous sulphate which are co-deposited on the objects to be copper plated and on the sidewalls of the tanks containing the acid copper plating baths.

The reagent, in a solid form or in a solution, which is used in the method according to the invention has to be such that it does not apply polluting elements to the copper plating bath.

In fact, the reagents have to be such that they do not require further treatments for their disposal, and such that they do not create problems in the step of treatment of the water used to wash the copper plated objects or in the event of use of the precipitated ferrous sulphate.

The method according to the invention includes the addition of one of the following compounds or their analogues in a solid form or in a solution:

sodium bicarbonate : $NaHCO_3$ sodium carbonate : $Na_2CO_3$ potassium bicarbonate: $KHCO_3$ potassium carbonate : $K_2CO_3$ calcium bicarbonate : $Ca(HCO_3)_2$ calcium carbonate : $CaCO_3$ sodium hydroxide : NaOH potassium hydroxide : KOH sodium bicarbonate $NaHCO_3$ and relative sulphate : $Na_2SO_4$ potassium bicarbonate : $KHCO_3$ and relative sulphate : $K_2SO_4$.

The choice of the type of reagent is governed by purely economic reasons inasmuch as the technical and technological results which can be achieved are substantially equal, irrespective of the type of reagent employed.

Experimental trials have shown that the above bicarbonates give the best results although at higher costs.

In the event of a centralised copper plating plant, in which the acid solution moves from a storage tank to a plurality of individual tanks, the addition of the reagent according to the invention can be carried out advantageously in the storage tank so as to ensure a substantially uniform composition fed to all the copper plating baths.

So as to assist the method according to the invention, the copper plating baths are advantageously stirred continuously by stirring assemblies, which are known in themselves, and are kept at a temperature higher than 25° C.

So as to have a reagent readily soluble and readily mixed in the copper plating bath, the bicarbonates are advantageously used in the copper plating bath rather than the other reagents, even though the results achieved are analogous to those achieved with the other reagents.

At the present time it is cheapest to use sodium salts. If potassium salts are used, the costs are higher even though the potassium sulphate ($K_2SO_4$) obtained as a secondary product by the method can be used as a fertiliser in agriculture.

In the method according to the invention the concentration of iron in the acid copper plating bath is always kept below the critical value of 60 grs/lt. for example, and crystals of ferrous sulphate $FeSO_4$ and sodium sulphate : $Na_2SO_4$ form and precipitate on the bottom of the tank.

These crystals deposited on the bottom possess their own content of copper and are therefore removed and washed in a solution of water and sulphuric acid ($H_2SO_4$) and yield, on the one hand, a flow of sulphuric acid and copper sulphate and, on the other hand, crystals of sodium sulphate ($Na_2SO_4$) and ferrous sulphate ($FeSO_4$).

The solution of sulphuric acid and copper sulphate thus obtained and also containing tolerable concentrations of ferrous sulphate ($FeSO_4$) and sodium sulphate ($Na_2SO_4$) can be used in the acid copper plating bath, while the washed and separated solid crystals can be sold to possible users or disposed of on dumps.

Moreover, the applicants have found to their surprise that the addition of one of these reagents, particularly the bicarbonates but also the carbonates and hydroxides, to the acid copper plating bath accelerates the depositing of copper on the objects to be copper plated.

The method according to the invention therefore enables the output of the copper plating plants to be increased, even though it leads to a greater consumption of sulphuric acid.

The sludges or sewage containing copper and coming, for instance, from acid copper plating baths, electrolytic copper plating baths, electrolytic or chemical copper engraving plants or other plants can be treated so as to recover the copper contained in them.

To be more exact, where the sludges have been generated by a treatment with lime to neutralise spent acid copper plating baths, the treatment consists in solubilising the sludges in an aqueous solution containing sulphuric acid ($H_2SO_4$) and in adding one of the aforesaid bicarbonates or carbonates or analogous compounds.

The addition of bicarbonates or carbonates solubilises the crystals of ferrous sulphate ($FeSO_4$) and copper sulphate ($CuSO_4$) in the sludge.

Where the sludges contain organic compounds such as stearates for instance, the addition of the above reagents causes the organic compounds to come to the surface, and the organic compounds can then be readily separated by flotation and be removed.

Moreover, depending on the type of bicarbonate or carbonate employed, deposits of sodium sulphate, potassium sulphate or calcium sulphate are also formed on the bottom of the tank.

By filtering or decanting the solution thus produced, there are obtained, on the one hand, a solid retained part comprising crystals of ferrous sulphate ($FeSO_4$), calcium sulphate ($CaSO_4$) and sodium or potassium sulphate, which can be disposed of without problems since there is no longer any copper content, and, on the other hand, a liquid solution containing sulphuric acid ($H_2SO_4$) and copper sulphate ($CuSO_4$); this solution contains also ferrous sulphate ($FeSO_4$) and sodium sulphate ($Na_2SO_4$) in concentrations such that they do not impair the copper plating process.

This solution can be re-used in its existing condition in acid copper plating baths, thus avoiding the production of discharges containing copper and also reducing the consumption of copper with a resulting saving.

As an alternative the solution can undergo a process of recovery of copper by precipitation.

By adding one of the reagents in the precipitation method too it is possible to obtain, on the one hand, metallic copper of a high degree of purity, which can be converted into copper sulphate and re-used on the spot, and, on the other hand, a sludge containing a concentration of copper even less than 1 mg/kg.

By means of the invention it is possible to eliminate the incrustations of crystals consisting of ferrous sulphate ($FeSO_4$) and copper sulphate ($CuSO_4$), which form a crust on the sidewalls and bottom of the tanks holding the acid copper plating baths.

In fact, these incrustations, when brought into contact with an aqueous solution containing sodium carbonate or bicarbonate, or potassium carbonate or bicarbonate, or calcium carbonate or bicarbonate, dissolve and provide an alkaline solution of a chestnut colour.

By then adding sulphuric acid ($H_2SO_4$), a solution is obtained with a substantially clear blue colour which contains dissolved copper sulphate ($CuSO_4$) and can be recycled in the acid copper plating baths, whereas a part of the ferrous and sodium sulphates contained is precipitated.

BRIEF DESCRIPTION OF THE DRAWINGS

The attached figures are given as a non-restrictive example and show some preferred solutions of the invention as follows.

DETAILED DESCRIPTION OF THE PREFERRED EMBODIMENTS

Figure 1:
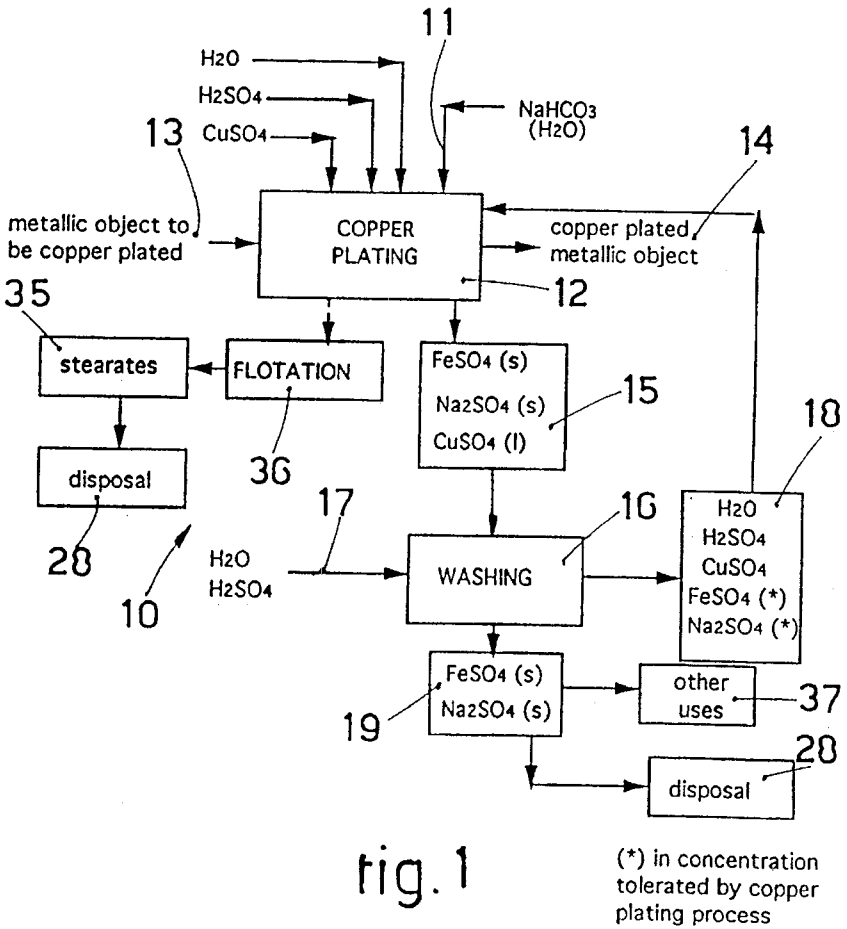
FIG. 1 is a block diagram of the method to treat acid copper plating baths according to the invention.

The reference number 10 in the attached figures denotes generally a method to prevent exhaustion of acid copper plating baths according to the invention.

The method 10 according to the invention includes a continuous or discontinuous addition 11 of sodium bicarbonate ($NaHCO_3$) in a solid form or in a solution to acid copper plating baths 12 consisting of an aqueous solution of sulphuric acid ($H_2SO_4$) and copper sulphate ($CuSO_4$), in which metallic objects 13 to be copper plated are immersed to produce copper plated metallic objects 14.

According to some variants the sodium bicarbonate ($NaHCO_3$) can be replaced by one of the following compounds or their analogues:

sodium carbonate : $Na_2CO_3$ potassium bicarbonate: $KHCO_3$ potassium carbonate : $K_2CO_3$ calcium bicarbonate : $Ca(HCO_3)_2$ calcium carbonate : $CaCO_3$ sodium hydroxide : NaOH potassium hydroxide : KOH sodium bicarbonate $NaHCO_3$ and relative sulphate : $Na_2SO_4$ potassium bicarbonate : $KHCO_3$ and relative sulphate : $K_2SO_4$.

During the copper plating, ions of iron pass into solution, whereas ions of copper pass from the solution onto the surface of the metallic objects 13 to be copper plated. With the addition of one of the above reagents the concentration of iron in the acid copper plating bath always stays below the critical value of 60 grs/lt., above which there would take place the co-deposition of crystals of ferrous sulphate and copper sulphate, which would be deposited on the surface of the metallic objects 13 to be copper plated and cause copper plating defects which would make those objects 13 unacceptable.

In the method 10 according to the invention crystals of ferrous sulphate and sodium sulphate which also contain copper sulphate 15 are deposited on the bottom of the acid copper plating bath 12.

Where organic compounds such as stearates, for instance, are present, those compounds are separated by flotation 36 and are sent thereafter for disposal 28.

This flow 15 of deposited crystals is then subjected to a step 16 of washing with an aqueous solution of sulphuric acid 17.

The washing step 16 provides, on the one hand, an aqueous solution of copper sulphate 18 containing ferrous sulphate and sodium sulphate in concentrations such that they do not impair the copper plating process. This flow 18 can then be re-cycled into the acid copper plating bath 12 without any problems.

Figure 2:
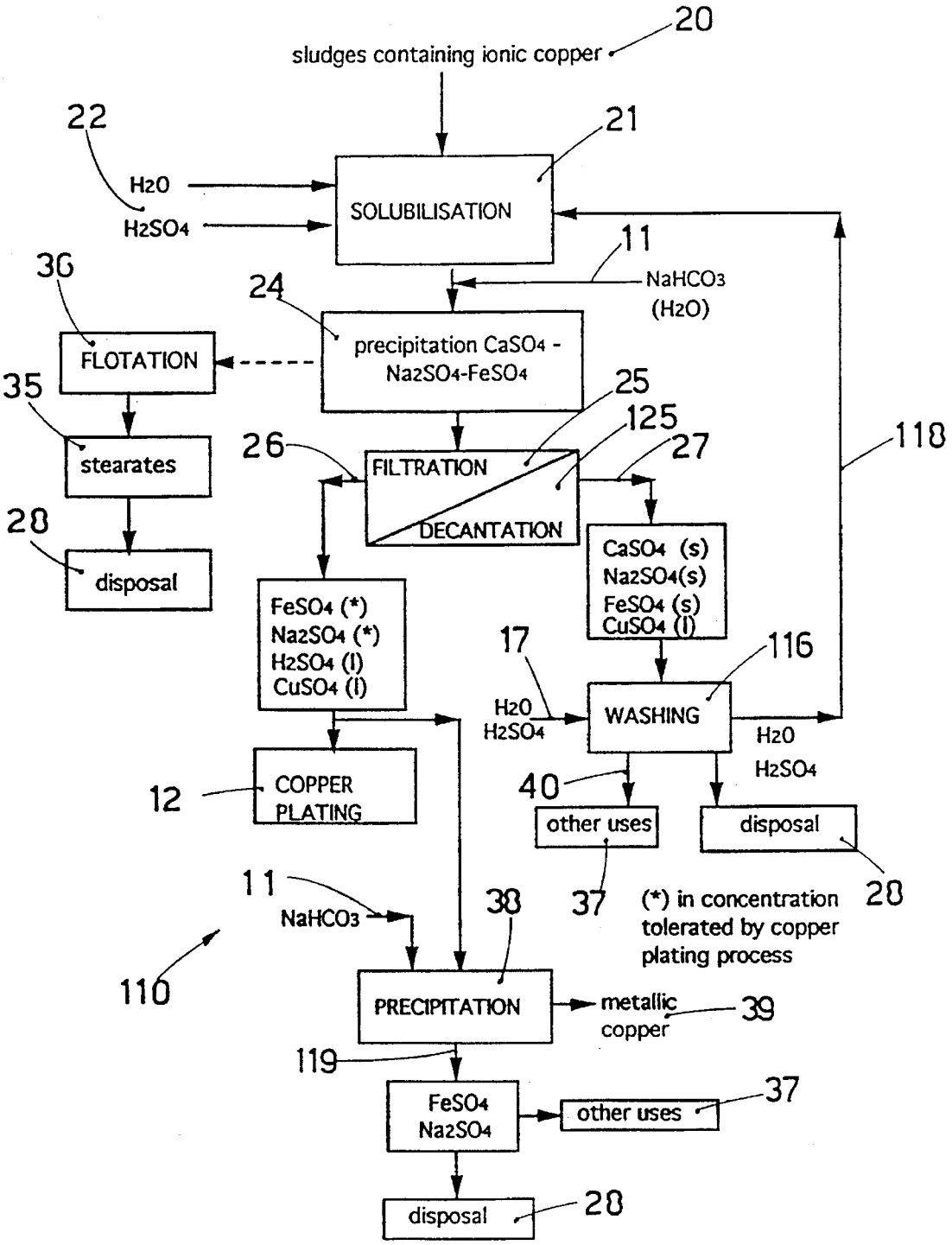
FIG. 2 is a block diagram of the method to treat fluids or sludges containing copper in an ionic form according to the invention.

From the washing step 16, on the other hand, crystals of ferrous sulphate and sodium sulphate 19 are recovered and are used in other fields 37 or are sent for disposal 28. FIG. 2 shows a method 110 for recovery of metallic copper from sludges 20 containing copper in the ionic state.

At the present time many temporary stocks of these sludges 20 exist inasmuch as no economically advantageous methods are known for recovery of the copper contained in these sludges 20.

These sludges 20 can be produced, for instance, by neutralising spent acid copper plating baths or the wash waters of copper plated metallic objects 14 by an addition of $Ca(OH)_2$.

The method 110 enables metallic copper to be recovered from these sludges 20 and includes a first step 21 of rendering the sludges 20 soluble in an aqueous solution of sulphuric acid 22 and a second step of adding sodium bicarbonate 11 in a solid form or in an aqueous solution. This second step causes formation and depositing 24 of calcium sulphate, ferrous sulphate and sodium sulphate.

Where these sludges 20 contain organic compounds such as stearates 35 for instance, these organic compounds are separated by flotation 36 and are sent thereafter for disposal 28.

A successive filtration step 35, or decantation step 125, makes possible the separation, on the one hand, of a flow of filtrate (or decanted material) 26 consisting of a liquid solution of sulphuric acid containing copper sulphate and, on the other hand, a flow of retained material 27 consisting of solid deposits of sodium sulphate, calcium sulphate and ferrous sulphate, which also incorporate copper sulphate.

This flow of filtrate (or decanted material) 26 contains also ferrous sulphate and sodium sulphate in concentrations such that they do not hinder the copper plating process.

The flow of filtrate (or decanted material) 26 can be reused directly in the acid copper plating bath 12 or can undergo a precipitation treatment 38 to recover metallic copper 39.

The addition of sodium bicarbonate 11 to the flow of filtrate (or decanted material) 26 subjected to the precipitation treatment 38 enables almost all the copper contained in that flow to be recovered and generates an outgoing flow which does not create problems of disposal 28.

The precipitation treatment 38 provides metallic copper 39 of a high degree of purity and a flow of ferrous sulphate and sodium sulphate 119 which can be sent for disposal 28 or for other uses 37.

The flow of retained material 27 undergoes washing 116 with an aqueous solution of sulphuric acid 17 and provides an output of an aqueous flow 118 of sulphuric acid, used in the step of making soluble 21 the sludges 20, and an output of a discharge sludge 40, which is sent for disposal; this discharge sludge 40 has a copper content of about a few mgs/kg., and therefore its disposal 28 creates no problem.

According to some variants the sodium bicarbonate ($NaHCO_3$) can be replaced by one of the following compounds or their analogues:

sodium carbonate : $Na_2CO_3$ potassium bicarbonate : $KHCO_3$ potassium carbonate $K_2CO_3$ calcium bicarbonate $Ca(HCO_3)_2$ calcium carbonate $CaCO_3$ sodium bicarbonate: $NaHCO_3$ and relative sulphate: $Na_2SO_4$ potassium bicarbonate :$KHCO_3$ and relative sulphate: $K_2SO_4$.

Figure 3:
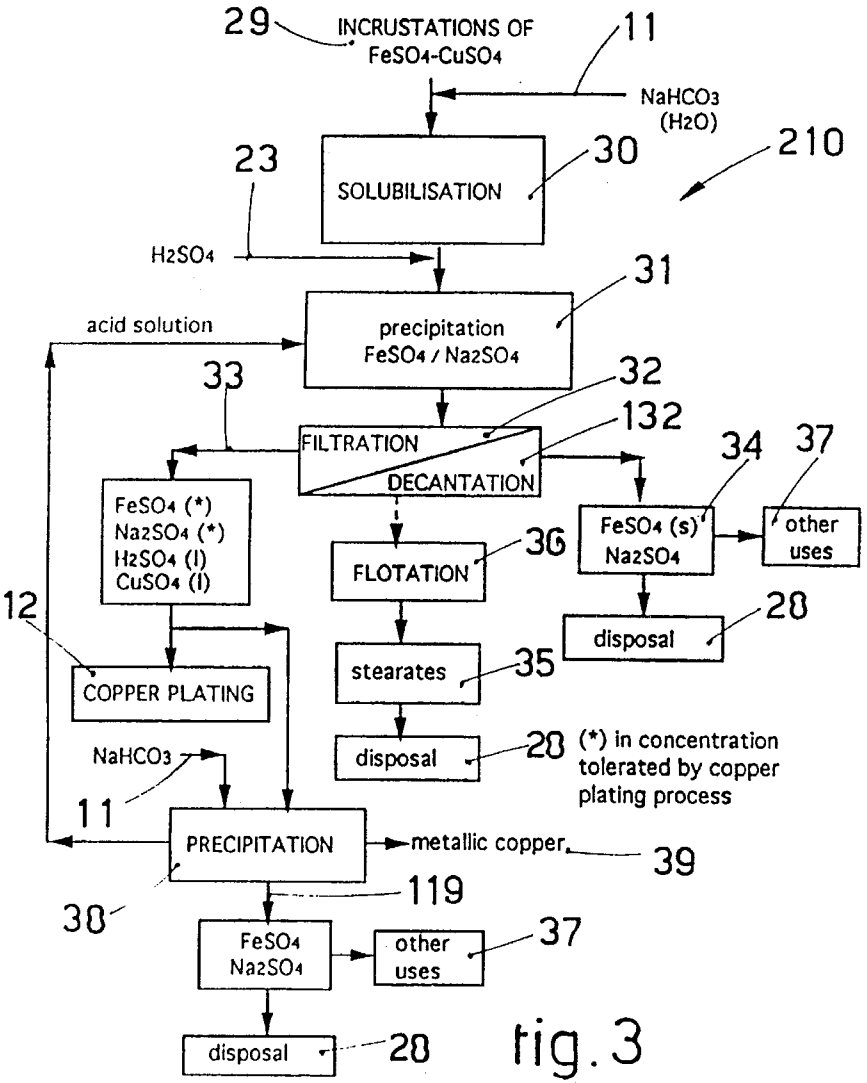
FIG. 3 is a block diagram of the method to treat incrustations of ferrous sulphate and copper sulphate according to the invention.

FIG. 3 shows a method 210 to treat and eliminate incrustations 29 generated by the co-depositing of ferrous sulphate and copper sulphate and formed on the sidewalls of the tanks containing the acid copper plating baths 12 and on the surface of the copper plated objects 14 when the concentration of iron in the acid copper plating baths 12 exceeds the critical value of 60 grs/lt.

The method 210 provides for the addition of sodium bicarbonate 11, which dissolves the incrustations 29 with the formation of an alkaline solution of a chestnut colour.

The successive addition of sulphuric acid 23 causes precipitation 31 of part of the crystals of ferrous sulphate and sodium sulphate and produces a solution of a substantially clear blue colour.

If organic compounds such as stearates 35, for instance, are present, these compounds are separated by flotation 36 and are sent thereafter for disposal 28.

A successive step of filtration 32, or decantation 132, makes possible the separation, on the one hand, of a flow of filtrate (or decanted material) 33 consisting of a liquid solution of copper sulphate in sulphuric acid, the solution containing also ferrous sulphate and sodium sulphate in concentrations such as will not hinder the copper plating process, and, on the other hand, of retained material 34 consisting of solid crystals of ferrous sulphate and sodium sulphate.

Whereas the flow of filtrate (or decanted material) 33 can be re-used directly in the acid copper plating baths 12, the retained material 34 is sent for disposal 28, which is much less problematical since the copper concentration is only about a few mgs/kg., or can be delivered for other uses 37.

The flow of filtrate (or decanted material) 33 can undergo a precipitation treatment 38 for the recovery of metallic copper 39.

The addition of sodium bicarbonate 11 to the flow of filtrate (or decanted material) 33 subjected to the precipitation treatment 38 enables almost all the copper contained in that flow 33 to be recovered and generates an outgoing flow which does not create disposal problems 28.

The precipitation treatment 38 yields metallic copper 39 of a high degree of purity and an output of ferrous sulphate and sodium sulphate 119 which can be sent for disposal 28 or be delivered for other uses 37.

According to some variants the sodium bicarbonate ($NaHCO_3$) can be replaced by one of the following compounds or their analogues:

sodium carbonate : $Na_2CO_3$ potassium bicarbonate: $KHCO_3$ potassium carbonate : $K_2CO_3$ calcium bicarbonate : $Ca(HCO_3)_2$ calcium carbonate : $CaCO_3$ sodium hydroxide : NaOH potassium hydroxide : KOH sodium bicarbonate : $NaHCO_3$ and relative sulphate: $Na_2SO_4$ potassium bicarbonate : $KHCO_3$ and relative sulphate: $K_2SO_4$.

We claim:

1. A method to prevent exhaustion of acid copper plating baths, comprising adding a compound to the bath to cause precipitation of iron in the form of ferrous sulphate so as to keep a concentration of iron below a value above which co-deposition of crystals of ferrous sulphate and copper sulphate would occur.

2. Method as in claim 1, in which the compound is added continuously.

3. Method as in claim 1, in which the compound is added discontinuously.

4. Method as in claim 1, in which the compound is sodium bicarbonate ($NaHCO_3$).

5. Method as in claim 1, in which the compound is sodium carbonate ($NaCO_3$) or its analogues.

6. Method as in claim 1, in which the compound is potassium bicarbonate ($KHCO_3$).

7. Method as in claim 1, in which the compound is potassium carbonate ($K_2CO_3$).

8. Method as in claim 1, in which the compound is calcium bicarbonate ($Ca(HCO_3)_2$).

9. Method as in claim 1, in which the compound is calcium carbonate ($CaCO_3$).

10. Method as in claim 1, in which the compound is sodium hydroxide (NaOH).

11. Method as in claim 1, in which the compound is potassium hydroxide (KOH).

12. Method as in claim 1, in which the compound is a mixture of sodium bicarbonate ($NaHCO_3$), and sodium sulphate ($Na_2SO_4$).

13. Method as in claim 1, in which the compound is a mixture of potassium bicarbonate ($KHCO_3$), and potassium sulphate ($K_2SO_4$).

14. Method as in claim 1, in which the compound is in a solid form.

15. Method as in claim 1, in which the compound is in the form of a solution.

16. Method as in claim 1, further comprising removing a flow containing the ferrous sulphate and sodium sulphate precipitates from the acid copper plating bath, washing the removed precipitates by an aqueous flow of sulfuric acid, thus generating a first output comprising an aqueous flow of sulfuric acid and copper sulphate containing ferrous sulphate and sodium sulphate in concentrations such as not to impair the copper plating process, the aqueous flow being re-cycled directly into the acid copper plating bath, and a second output comprising crystals of ferrous sulphate and sodium sulphate.

17. Method as in claim 1, further comprising, after adding the compound, filtering or decanting the solution, thus generating a retained material and a filtrate comprising a liquid solution containing copper sulphate.

18. Method as in claim 17, in which the compound is at least one compound selected from the group consisting of $NaHCO_3$, $Na_2CO_3$, $KHCO_3$, $K_2CO_3$, $Ca(HCO_3)_2$, $CaCO_3$, $NaHCO_3$, $Na_2SO_4$, $KHCO_3$, and $K_2SO_4$.

19. Method as in claim 17, further comprising washing the retained material with an aqueous flow of sulphuric acid, thus generating an aqueous flow of sulphuric acid, which is re-cycled directly to a step of making the sludges soluble, and a discharge sludge.

20. Method as in claim 1, in which the bath is subjected to flotation to separate any organic compounds included which are sent thereafter for disposal.

21. Acid copper plating baths obtained according to the method of claim 1.

22. Method as in claim 1, wherein the compound is added so as to keep the concentration of iron below 60 grs/lt.

23. Method as in claim 1, wherein the compound is added so as to keep the concentration of iron below 20 grs/lt.

24. A method to treat sewage or sludge containing copper, comprising:

providing an acidic aqueous solution containing the sewage or sludge; and adding a compound to the acidic aqueous solution to cause precipitation of iron in the form of ferrous sulphate and to form a solution containing copper sulphate.

* * * * *